US012228379B2

(12) United States Patent
Ly et al.

(10) Patent No.: US 12,228,379 B2
(45) Date of Patent: Feb. 18, 2025

(54) OUTER CARRIER WITH OVERHEAD-DEPLOYABLE POUCH FOR ARMOR OR OTHER INSERT

(71) Applicant: 5.11, Inc., Irvine, CA (US)

(72) Inventors: John Ly, Lakewood, CA (US); Jodie Udzenija, Tustin, CA (US); Shannon Martin, Huntington Beach, CA (US); Will Ayres, San Clemente, CA (US)

(73) Assignee: 5.11, Inc., Costa Mesa, CA (US)

( * ) Notice: Subject to any disclaimer, the term of this patent is extended or adjusted under 35 U.S.C. 154(b) by 215 days.

(21) Appl. No.: 17/849,468

(22) Filed: Jun. 24, 2022

(65) Prior Publication Data

US 2023/0417511 A1 Dec. 28, 2023

(51) Int. Cl.
*F41H 1/02* (2006.01)
*F41H 5/013* (2006.01)

(52) U.S. Cl.
CPC ..... *F41H 1/02* (2013.01); *F41H 5/013* (2013.01)

(58) Field of Classification Search
CPC ..... F41H 1/02; F41H 5/013; A45F 3/06
See application file for complete search history.

(56) References Cited

U.S. PATENT DOCUMENTS 6,419,132 B1 * 7/2002 Reed ..... A45C 15/00 2/2.5
6,685,071 B2 * 2/2004 Prather ..... F41H 5/08 2/2.5
7,987,523 B2 * 8/2011 Cole ..... F41H 1/02 2/102
10,130,160 B1 * 11/2018 Cheng ..... A45F 4/02
10,188,197 B2 * 1/2019 Fraile Nuez ..... A45F 3/047
11,026,501 B1 * 6/2021 Dabrowka ..... F41H 1/02
11,181,343 B2 * 11/2021 Ross ..... F41H 1/02
11,344,104 B2 * 5/2022 Miller ..... F41H 5/08
2009/0014490 A1 * 1/2009 Bradley ..... A45F 3/04 224/576
2017/0102214 A1 * 4/2017 Wright ..... F41H 5/08
2019/0174903 A1 * 6/2019 Holder ..... A45F 3/06
(Continued)

OTHER PUBLICATIONS

PCT Application No. PCT/US2023/068618, "Outer Carrier With Overhead-Deployable Pouch for Armor or Other Insert", filed Jun. 16, 2023.

(Continued)

*Primary Examiner* — F Griffin Hall
(74) *Attorney, Agent, or Firm* — Kilpatrick Townsend & Stockton LLP

(57) ABSTRACT

An armor system can include a carrier configured to be donned into a worn position on a torso of a wearer. The carrier can include a front panel configured to be positioned along an anterior of the torso in the worn position. The carrier can further include a rear panel configured to be positioned along a posterior of the torso in the worn position. The armor system can further include an armor pouch attached or attachable by at least one strap to the carrier so as to be reconfigurable by overhead movement between (i) a loading configuration in which the armor pouch is suspended by the strap and hanging along and exterior to the front panel, and (ii) a protection configuration in which the armor pouch is suspended by the strap and is overlaying an exterior portion of the rear panel.

17 Claims, 10 Drawing Sheets

(56) References Cited

U.S. PATENT DOCUMENTS

| | | | | |
|---|---|---|---|---|
| 2019/0380478 | A1 | 12/2019 | Rushing | |
| 2020/0025523 | A1* | 1/2020 | Ross | A45F 3/06 |
| 2021/0000246 | A1* | 1/2021 | Alson | A45F 3/06 |

OTHER PUBLICATIONS

PCT/US2023/068618, "International Search Report and the Written Opinion", Sep. 8, 2023, 13 pages.

* cited by examiner

OUTER CARRIER WITH OVERHEAD-DEPLOYABLE POUCH FOR ARMOR OR OTHER INSERT

BACKGROUND

Outer carriers may have a form factor of a vest, for example, including shoulder yokes that rest on a wearer's shoulders and support respective front and back panels that each include pockets for receiving plates. Such a plate is typically a generally rigid body (e.g., with an overall shape that is flat or at least partially curved) and may include ballistic material or non-ballistic material, depending on the context of use for the outer carrier. For example, for military, law enforcement, or other tactical contexts, a ballistic plate may be inserted and retained within a pocket in an outer carrier to provide protection for the wearer against injury from bullets or other projectiles. The pocket may allow for different sizes of plates, for example. Many outer carriers feature length-adjustable straps to secure different size plates such as large, medium, or small. This may allow for flexibility for a user to select between different plate sizes (e.g., among different footprints and/or thicknesses), such as to customize the plate used for a particular situation and trade-off between weight and level of ballistic protection.

BRIEF SUMMARY

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented later.

In various embodiments, an outer carrier can be coupled by straps to an armor pouch that can be moved from a position hanging along a front of a wearer, in a path over the wearer's head, and to a position overlaying a rear of the outer carrier. The pouch can contain an insert so that a level of posterior armor protection can be augmented by the placement of the pouch along the rear of the outer carrier. For example, the pouch may allow the wearer to add armor along the wearer's back without doffing the vest to add armor in a rear pocket that may be not readily reachable by the wearer's arms while the outer carrier is worn and/or without relying on another individual to reach such a rear pocket for the wearer. Releasable connectors may be included along the sides and/or top of the outer carrier to secure the pouch in position along the rear of the outer carrier. For example, releasable connectors along the wearer's side may be released to allow the pouch to swing overhead to the front for loading and/or unloading, and the pouch may be swung overhead from front to back into a suitable position for securing by the releasable connectors. Releasable connectors along the top of the outer carrier may allow the pouch to be fully removed, e.g., such that the outer carrier can be utilized independent of the pouch or supplemented with the pouch as desired.

In some embodiments, provided is a method of augmenting a level of posterior armor protection for a wearer without requiring assistance from another individual and without requiring doffing to load armor. The method can include positioning an armor pouch in a front position in which the armor pouch is suspended by at least one strap from a carrier worn by the wearer and in which the armor pouch is hanging along a front side of the carrier. The method can further include pivoting the armor pouch overhead to a rear position in which the armor pouch is suspended by the strap and is overlaying an exterior portion of a rear side of the carrier worn by the wearer.

In some embodiments, provided is an armor system. The system can include a carrier configured to be donned into a worn position on a torso of a wearer. The carrier can include a front panel and a rear panel. The front panel can be configured to be positioned along an anterior of the torso in the worn position. The rear panel can be configured to be positioned along a posterior of the torso in the worn position. The carrier can further include an armor pouch attached or attachable by at least one strap to the carrier so as to be reconfigurable by overhead movement between (i) a loading configuration in which the armor pouch is suspended by the strap and hanging along and exterior to the front panel, and (ii) a protection configuration in which the armor pouch is suspended by the strap and is overlaying an exterior portion of the rear panel.

In some embodiments, provided is an armor system. The armor system can include a carrier configured to be donned into a worn position on a torso of a wearer. The carrier can include a rear panel configured to be positioned along a posterior of the torso in the worn position. The carrier can further include a front panel configured to be positioned along an anterior of the torso in the worn position. The carrier can further include a set of straps and releasable connectors. The set can include an upper left strap attached at an upper left portion of the carrier and bearing an upper left releasable connector. The set can further include an upper right strap attached at an upper right portion of the carrier and bearing an upper right releasable connector. The set can further include a lower left strap attached at a lower left portion of the carrier and bearing a lower left releasable connector. The set can further include a lower right strap attached at a lower right portion of the carrier and bearing a lower right releasable connector. The set of straps and releasable connectors can be arranged to facilitate attachment by the upper left releasable connector and the upper right releasable connector to an upper portion of an armor pouch so as to render the armor pouch pivotable by the upper left strap and the upper right strap for overhead movement of the armor pouch to a rear position in which the armor pouch is overlaying an exterior portion of the rear panel and attachable at a lower portion of the armor pouch with the lower left releasable connector and the lower right releasable connector.

For a fuller understanding of the nature and advantages of the present invention, reference should be made to the ensuing detailed description and accompanying drawings.

BRIEF DESCRIPTION OF THE DRAWINGS

In the following description, various embodiments of the present invention will be described. For purposes of explanation, specific configurations and details are set forth in order to provide a thorough understanding of the embodiments. However, it will also be apparent to one skilled in the art that the present invention may be practiced without the specific details. Furthermore, well-known features may be omitted or simplified in order not to obscure the embodiment being described.

DETAILED DESCRIPTION

In the following description, various embodiments of the present invention will be described. For purposes of explanation, specific configurations and details are set forth in order to provide a thorough understanding of the embodiments. However, it will also be apparent to one skilled in the art that the present invention may be practiced without the specific details. Furthermore, well-known features may be omitted or simplified in order not to obscure the embodiment being described.

Figure 1:
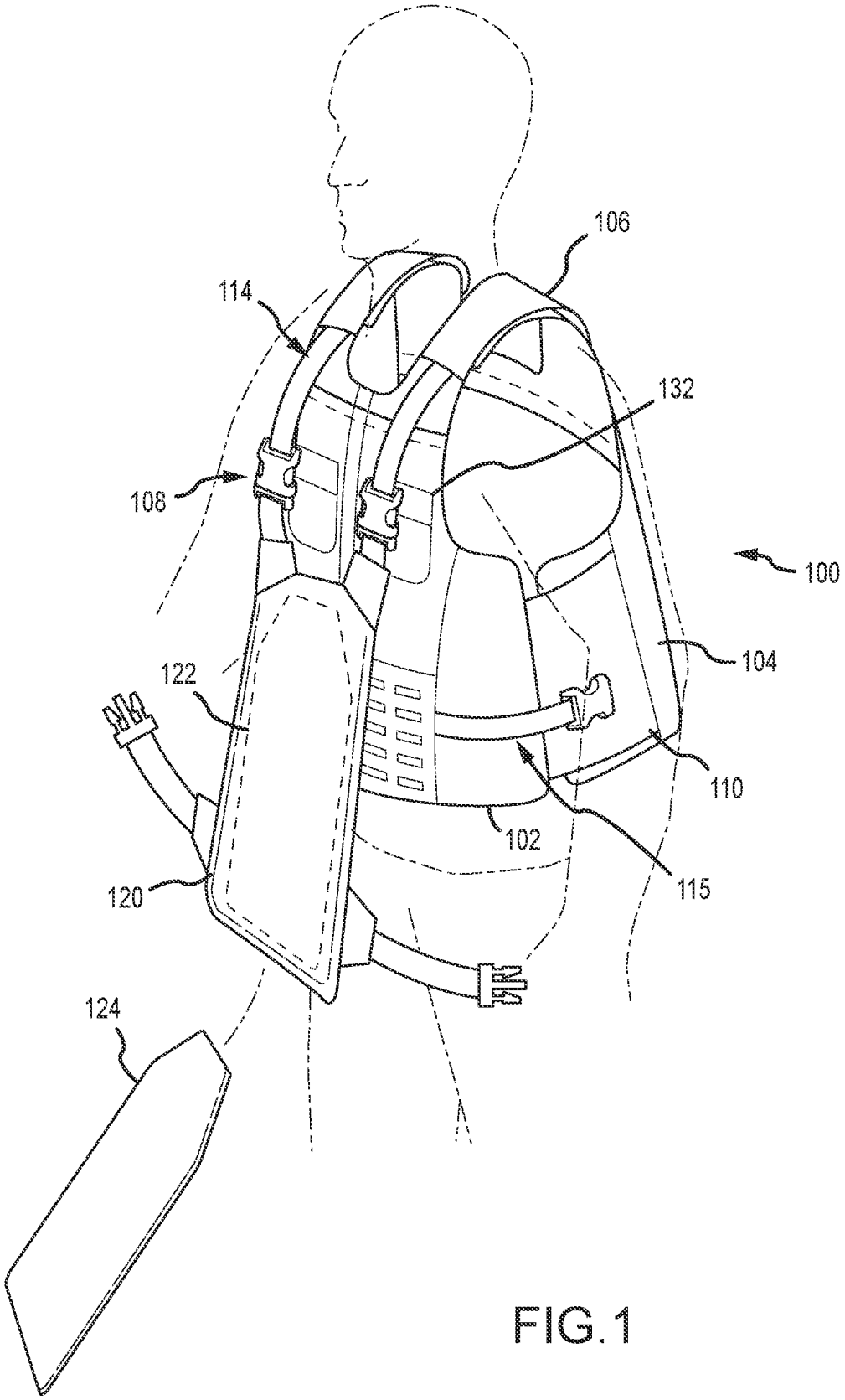
FIG. 1 shows a perspective view of an outer carrier with an overhead-deployable pouch in a front position according to various embodiments.
Figure 2:
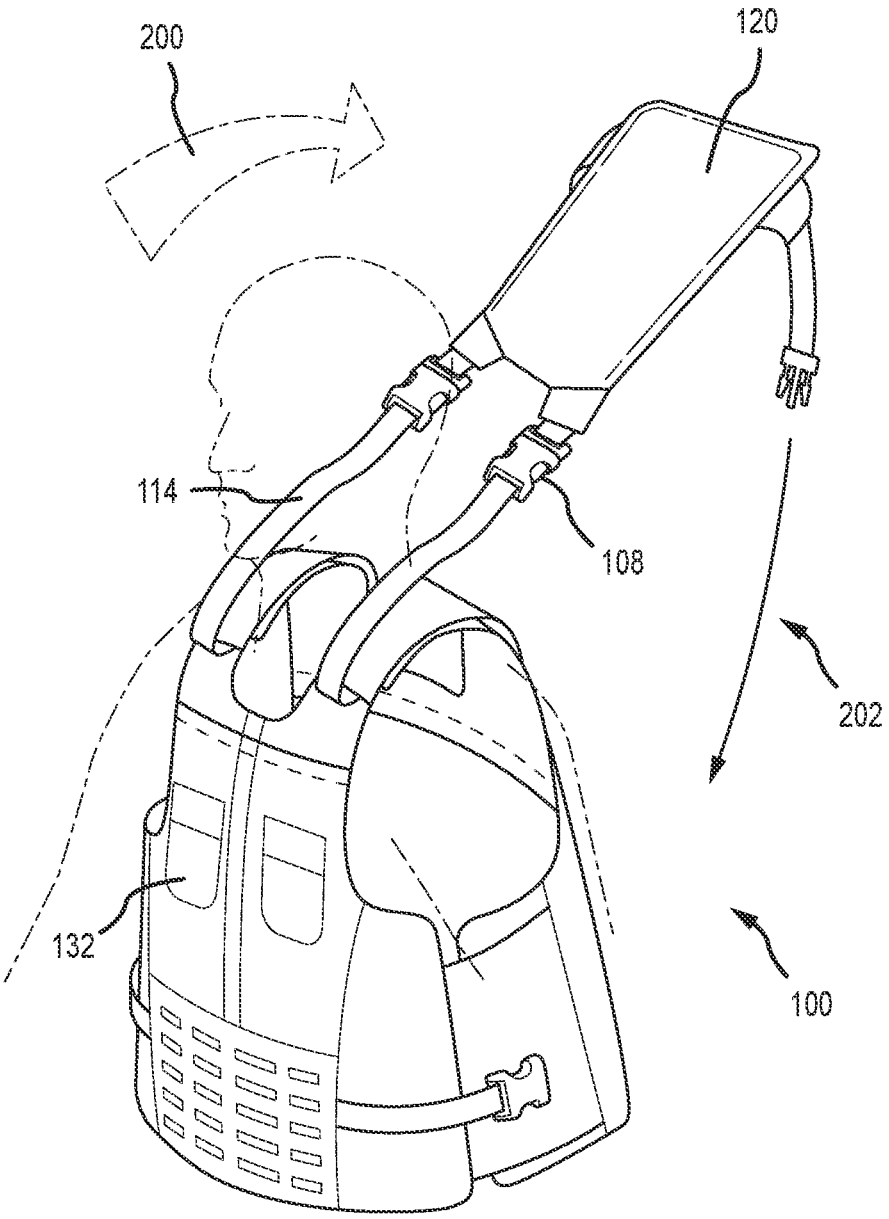
FIG. 2 shows a perspective view of the outer carrier of FIG. 1 with the overhead-deployable pouch at least partially pivoted overhead by a strap according to various embodiments.
Figure 3:
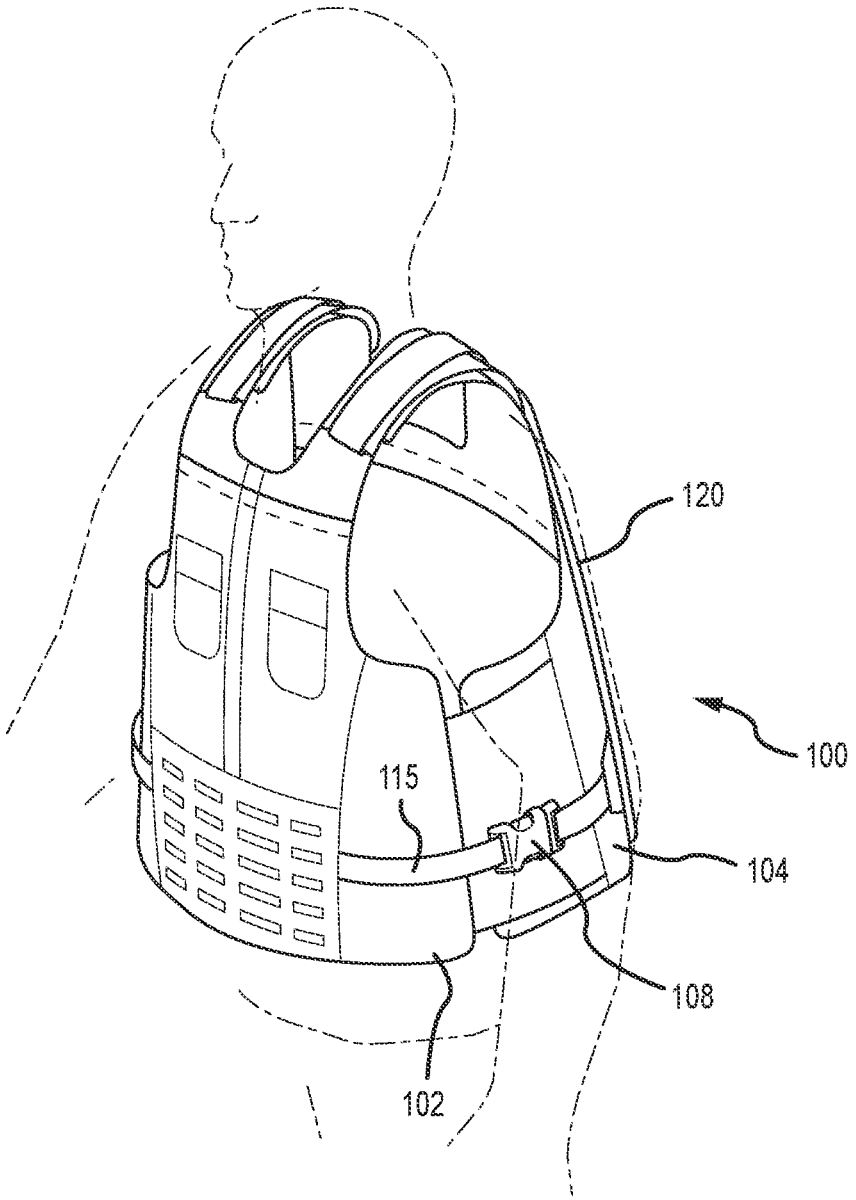
FIG. 3 shows a perspective view of the outer carrier of FIG. 1 with the overhead-deployable pouch in a rear position according to various embodiments.

Referring now to the drawings, in which like reference numerals represent like parts throughout the several views, FIGS. 1 through 3 show an outer carrier 100 with a pouch 120. The pouch 120 may enable a wearer to augment a level of posterior armor protection in use. For example, the pouch 120 may allow the level of posterior armor protection to be augmented without requiring assistance from another individual and/or without requiring the wearer to doff the outer carrier 100 to load armor. Generally, FIGS. 1, 2, and 3 show perspective views of the outer carrier 100 with the pouch 120 in different positions.

The outer carrier 100 can be donned into a worn position on or around the torso of a wearer. The outer carrier 100 may have a form factor of a vest, for example. In various examples, the carrier 100 can include a front panel 102 and a rear panel 104. The front panel 102 and the rear panel 104 may be arranged, respectively, along the front and rear of the torso of a wearer in use. For example, the front panel 102 and the rear panel 104 may be attached by a shoulder yoke 106 or any other suitable arrangement of straps or members that extend over one or more shoulders of the wearer in use to connect the front panel 102 with the rear panel 104 and support the front panel 102 and the rear panel 104 relative to the user's torso. Additionally or alternatively, the outer carrier 100 can include a cummerbund 110. In use, the cummerbund 110 may extend at least partially around the wearer's torso to retain or hold in place parts of the outer carrier 100 relative to the torso of the wearer.

The cummerbund 110 may attach the front panel 102 and the rear panel 104 to one another, e.g., along sides of the wearer's torso. The cummerbund 110 can include multiple parts (which may be noncontiguous). For example, the cummerbund 110 can include a first lateral cummerbund segment and a second lateral cummerbund segment. In use, the first lateral cummerbund segment may be arranged along a first lateral side of the wearer's torso (e.g., one of the left side or the right side), and the second lateral cummerbund segment may be arranged along a second lateral side of the wearer's torso (e.g., the other of the left side or the right side). The cummerbund 110 may be adjustable in length to accommodate different girths of torso in use. Respective ends of the cummerbund 110 and/or segments thereof may be captured within or along the front panel 102 and/or the rear panel 104 by variable amounts, which may be adjusted to change how much of the cummerbund 110 instead extends between the front panel 102 and rear panel 104.

The pouch 120 may be sized to receive an insert 124. The insert 124 can be a generally rigid body or exhibit a degree of flexibility to allow some amount of conforming to a body part of the wearer or other shape. Any suitable shape of the insert 124 can be used, including but not limited to flat or at least partially curved. The insert 124 can be a uniform thickness or may vary in thickness to provide a desired contour, for example, to match a contour of a body part along which the insert 124 is to be positioned in use. The insert 124 may correspond to ballistic material or weighted material, depending on the application or use desired by the wearer of the outer carrier 100. Non-limiting examples of types of material that may be included in the insert 124 can include ceramic (such as boron carbides), metal (such as steel, titanium, aluminum, or alloys), fabric (such as aramid fabrics), plastic (such as ultra-high molecular weight polyethylene), or polymer. In some examples, a ballistic insert and a non-ballistic weighted insert may feature similar materials (such as metal) but may differ as to the presence or absence of a ballistic rating due to differences in number of layers, thickness of layers, combination with other materials, or other variations in configuration.

The pouch 120 can be coupled to the outer carrier 100 by one or more straps, e.g., upward straps 114. The pouch 120 can be suspended by the upward straps 114, for example. The upward straps 114 may be suitably arranged to facilitate pivoting of the pouch 120 over the head of the wearer when the outer carrier 100 is worn. For example, the straps 114 may be sized and spaced apart for passing by respectively on a left side and a right side of a head of the wearer during pivoting for reconfiguration of a position of the pouch 120. In some examples, the upward straps 114 can be attached by fixed ends to the shoulder yoke 106, the front panel 102, or the rear panel 104 to enable opposite ends of the upward straps 114 to pivot. Once pivoted, the upward straps 114 may overlay portions of the shoulder yoke 106, for example.

The pouch 120 may include a pocket 122 or other hollow portion that can receive the insert 124. For example, the wearer of the outer carrier 100 may be able to load the insert 124 into the pouch 120. The insert 124 may be loaded into the pocket 122 of the pouch 120 through an opening in the bottom of the pouch 120, e.g., by lifting the insert 124 upward and guiding the insert 124 into the pouch 120. Additionally or alternatively, the insert 124 can be loaded into the pocket 122 of the pouch 120 through an opening in the top or a side of the pouch 120. The pouch 120 may be sealable such that the insert 124 can be encapsulated within the pocket 122 of the pouch 120. For example, the opening can include a zipper, hook and loop closure, or other fastener usable to seal the pouch 120.

The wearer can, by using the pouch 120 equipped with the insert 124, augment a level of posterior armor protection. The augmenting may be done without requiring assistance from another individual and/or without requiring the wearer to doff the outer carrier 100 to load armor. To augment the level of posterior armor, the wearer can position the pouch 120 in a front position, such as depicted in FIG. 1. For example, the pouch 120 may be suspended along a front-facing side of the outer carrier 100 while the pouch 120 is in the front position. As depicted by the arrow 200 in FIG. 2, the wearer can pivot the pouch 120 overhead (e.g., with the anchor points of the upward straps 114 acting as pivot points). The pouch 120 can be pivoted overhead (e.g., also over the shoulders of the wearer) to a rear position, such as depicted in FIG. 3. For example, once in the rear position, the pouch 120 may be overlaying an exterior portion of the rear side of the outer carrier 100 (e.g., overlaying the rear panel 104). In the rear position, the pouch 120 may provide a supplemental layer of armor e.g., over other armor that may be present within the rear panel 104 or if further armor is not otherwise contained within the rear panel 104.

Figure 4:
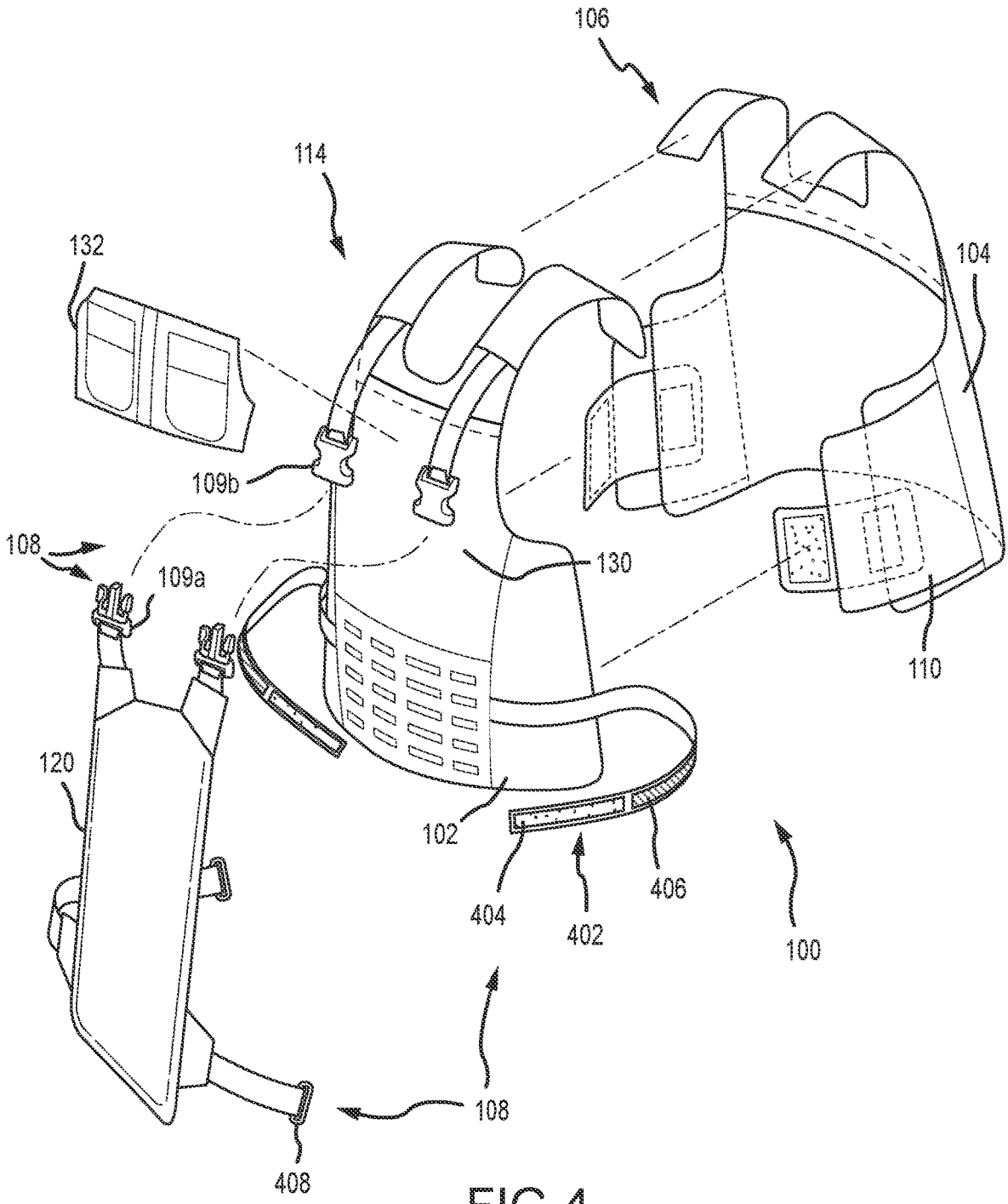
FIG. 4 is an exploded view of the outer carrier of FIG. 1 with an overhead-deployable pouch according to various embodiments.

FIG. 4 is an exploded view of the outer carrier 100 according to some embodiments. FIG. 4 is discussed with reference to various components that are also present in FIGS. 1-3.

Among other things, FIG. 4 depicts the pouch 120 in a state of being detached from the outer carrier 100. In various examples, the pouch 120 being fully detachable from the outer carrier 100 may allow the outer carrier 100 to be utilized independently of the pouch 120, e.g., such that the pouch 120 may be readily added if and when the wearer deems warranted. The pouch 120 can be releasably attachable to one or more upward straps 114 and/or to one or more sideward straps 115, e.g., as shown in the exploded view of FIG. 4. One or more releasable connectors 108 can be utilized to enable releasable attachment of the pouch 120. Any suitable structure of releasable connector 108 may be utilized, including, but not limited to, examples described in greater detail herein. Moreover, a releasable connector 108 at one location may be of a like type or a different type from a releasable connector 108 at another location.

The pouch 120 can be releasably attachable to an upward strap 114 via a releasable connector 108. In the example depicted in FIG. 4, the releasable connector 108 is shown to include a side-release buckle having a male portion 109A that can be sized to mechanically engage with a female portion 109B. For example, the male portion 109A is shown affixed to the pouch 120, and the female portion 109B may be affixed to the upward strap 114. The releasable connector 108 is not limited to such configuration, however. For example, the female portion 109B may be affixed to the pouch 120, and the male portion 109A may be affixed to an end of the upward strap 114. As another example, other forms of releasable connectors 108 may be utilized, e.g., including, but not limited to other forms of releasable connectors discussed herein.

Suitable structure may be included to secure the pouch 120 in the rear position in use. For example, as may be best seen with reference to FIG. 3, a releasable connector 108 may extend along a lateral side of the carrier 100. The pouch 120 may be releasably secured in the rear position by engaging the releasable connector 108. One portion of the releasable connector 108 can be affixed to a sideward strap 115 that can be anchored by one end to the front panel 102, the cummerbund 110, or the rear panel 104. An opposite mating portion of the releasable connector 108 may be anchored to the pouch 120. Any suitable structure for the releasable connector 108 may be utilized. As one example (e.g., depicted in FIGS. 1-3), the releasable connector 108 can include a side-release buckle that may include a male portion that can be sized to align with and mechanically engage with a female portion (e.g., as illustrated by arrow 202 in FIG. 2). As with the example noted above for attaching with the upward strap 114, the releasable connector 108 for attaching with the sideward strap 115 may be reversible in arrangement whether the male portion or the female portion is respectively mounted to the pouch 120 or the main structure of the carrier 100. Other forms of releasable connectors 108 additionally or alternatively may be utilized, e.g., including, but not limited to other forms of releasable connectors discussed herein.

As another example of a releasable connector 108, the side-release buckle on the sideward strap 115 of FIG. 3 is shown replaced in FIG. 4 with a structure that utilizes a hook-and-loop fastener 402. The hook and loop fastener 402 can include a hook segment 404 and a loop segment 406. In some examples, the hook segment 404 can be pulled through a ring 408 that can be affixed to the pouch 120. The hook and loop fastener 402 can be folded about the ring 408 such that the hooks of the hook segment 404 mechanically engage with the loops of the loop segment 406 and secure the hook and loop fastener 402 about the ring 408. Placement of the hook segment 404 and the loop segment 406 may be reversed regarding which is closer to a free end of the respective strap and/or regarding which is arranged to pass through the ring 408. Additionally or alternatively, arrangement may be reversed regarding which of the ring 408 or the hook and loop fastener 402 is respectively mounted to the pouch 120 or the main structure of the carrier 100. Moreover, the releasable connector 108 with the ring 408 and the hook and loop fastener 402 is not limited to facilitating engagement along the sideward strap 115, but may additionally or alternatively be utilized for facilitating engagement along the upward strap 114 and/or elsewhere on the carrier 100 and/or the pouch 120.

Other forms of releasable connector 108 can include a cam buckle, a ratchet buckle, a roller buckle, a slide buckle, a snap buckle, a tie buckle, or other suitable structure for accomplishing releasable connection. In some examples, the releasable connector 108 can include or be coupled with a strap. In some examples, the strap may be routed over a bar other suitable structure in the releasable connector 108 to effectuate length adjustability of the strap.

In some examples, various other elements of the outer carrier 100 may be releasable from one another. As one example, an exchangeable gear set 132 can be releasably affixed to the front panel 102 of the outer carrier 100, such as by hook and loop structure and/or another interface for facilitating exchangeability. In some examples, the exchangeable gear set 132 can include pockets, pouches, patches, identification markers, or any other suitable gear that can be mounted to the front panel 102. In some examples, the exchangeable gear set 132 may additionally or alternatively be attachable to the rear panel 104 of the outer carrier 100. As another example, elements of the shoulder yoke 106 and/or the cummerbund 110 may be individually releasable in conventional or specialized manners (e.g., so that parts with the front panel 102 and the rear panel 104 may be separable) and/or may be adjustable in length to accommodate different girths of torso and/or snugness of fit in use.

Figure 5:
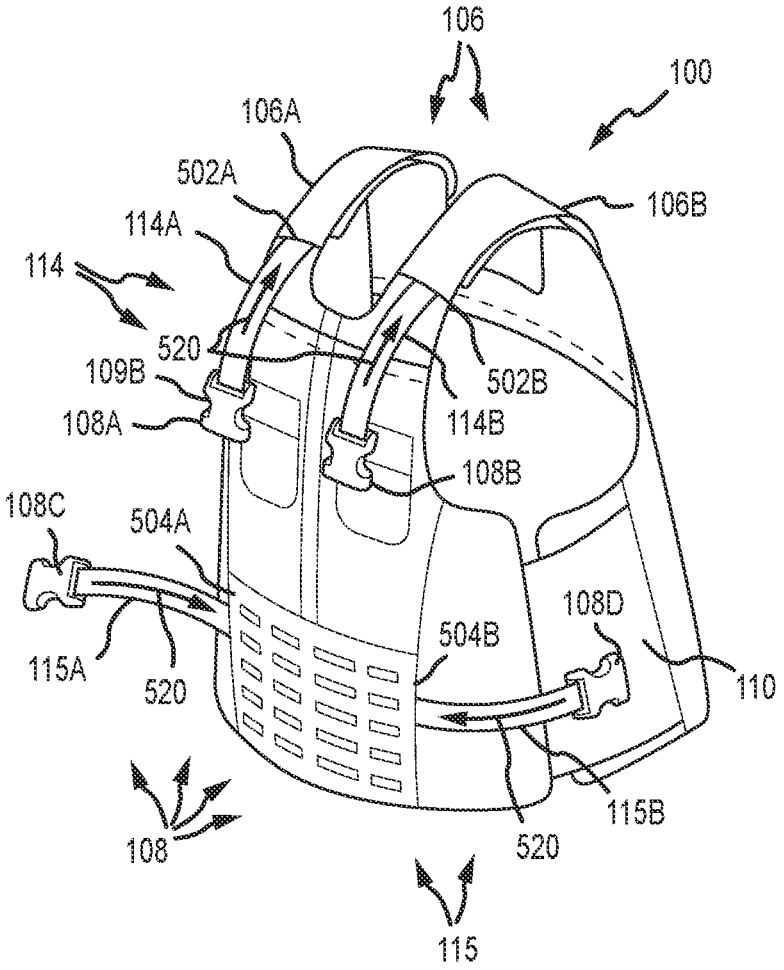
FIG. 5 is a perspective view of the outer carrier of FIG. 1 independent of the overhead-deployable pouch according to various embodiments.
Figure 6:
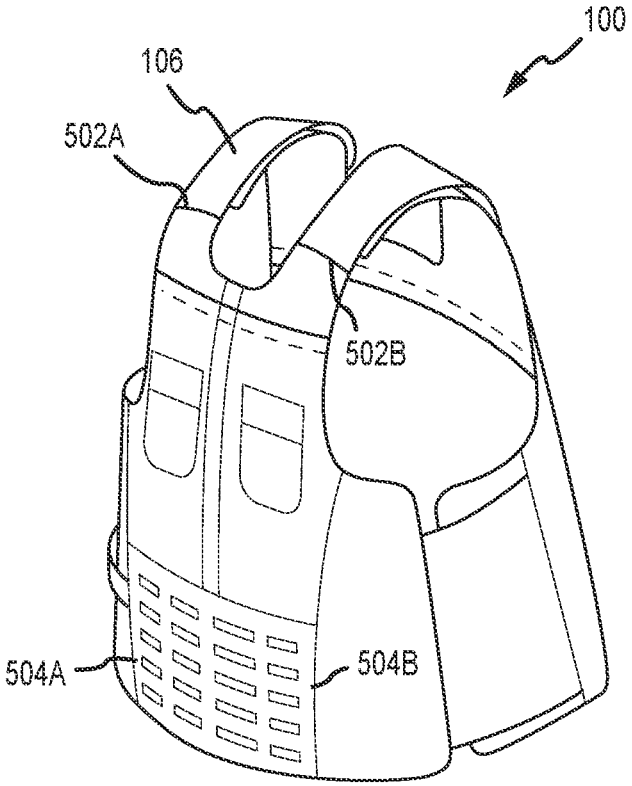
FIG. 6 is a perspective view of the outer carrier of FIG. 1 with releasable connectors stowed according to various embodiments.

FIGS. 5-6 are perspective views of an outer carrier 100 that can receive an overhead-deployable pouch 120 according to some embodiments. Various features of the outer carrier 100 may be present in multiples to facilitate functions of the outer carrier 100.

In FIG. 5, the shoulder yoke 106 is shown to include a left shoulder strap 106A and a right shoulder strap 106B. The left shoulder strap 106A and the right shoulder strap 106B may be individual straps that are separately attached to the carrier 100 or may correspond to respective portions of a unitary structure that may make up the shoulder yoke 106.

The outer carrier 100 can include suitable structures for connecting with the pouch 120. For example, the upward straps 114 can include a left upward strap 114A and a right upward strap 114B.

The left upward strap 114A may be attachable at an upper left portion of the outer carrier 100. The left upward strap 114A can be coupled to an upper left releasable connector 108A.

The right upward strap 114B can be attached at an upper right portion of the outer carrier 100. The right upward strap 114B can be coupled to an upper right releasable connector 108B.

The sideward straps 115 can include a lower left sideward strap 115A and a lower right sideward strap 115B. The lower left sideward strap 115A can be attached at a lower left portion of the outer carrier 100 and can have a lower left releasable connector 108C. The lower right sideward strap 115B can be attached at a lower right portion of the outer carrier 100 and can bear a lower right releasable connector 108D.

The upward straps 114 and releasable connectors 108 can enable the pouch 120 to couple with the outer carrier 100 by the releasable connectors 108 to an upper portion of the pouch 120. Attachment with the pouch 120 by the left upward strap 114A and the right upward strap 114B may facilitate overhead movement of the pouch to a rear position in which the pouch 120 is overlaying an exterior portion of the rear panel 104 and attachable at a lower portion of the pouch 120 with the lower left releasable connector 108C and the lower right releasable connector 108D.

The outer carrier 100 may be capable of stowing various elements. Any of the straps 114 and/or 115 may be adjustable for length and/or stowable in the outer carrier 100 (e.g., as illustrated by arrows 520 in FIG. 5). For example, the left upward strap 114A may be stowed in an upper left sleeve 502A that can be positioned on or beneath the left shoulder strap 106A or at another suitable location on the carrier 100. Additionally or alternatively, the right upward strap 114B can be stowed in an upper right sleeve 502B that can be positioned on or beneath the right shoulder strap 106B or at another suitable location on the carrier 100. Similarly, the left sideward strap 115A can be stowed within a lower left sleeve 504A that can be positioned on a lower left portion of the front panel 102 or at another suitable location on the carrier 100. Additionally or alternatively, the right sideward strap 115B can be stowed within a lower right sleeve 504B that can be positioned on a lower right portion of the front panel 102 or at another suitable location on the carrier 100. The lower left sleeve 504A and the lower right sleeve 504B may be separate from one another or may be portions of a single sleeve that extends across the front panel 102, for example.

The upward straps 114A-B and the sideward straps 115A-B are shown stowed in FIG. 6. Stowing may facilitate use of the outer carrier 100 in circumstances in which the pouch 120 is not attached and may avoid dangling structure in such scenarios. Stowing may be facilitated by sizing sleeves 502*a*, 502*b*, 504*a*, and/or 504*b* for a friction fit to retain stowed elements. Additionally or alternatively, the straps 114A, 114B, 115A, and/or 115B may include elastic material and/or may otherwise be coupled with suitable structure for causing automatic retraction when not extended for coupling with the pouch 120.

Figure 7:
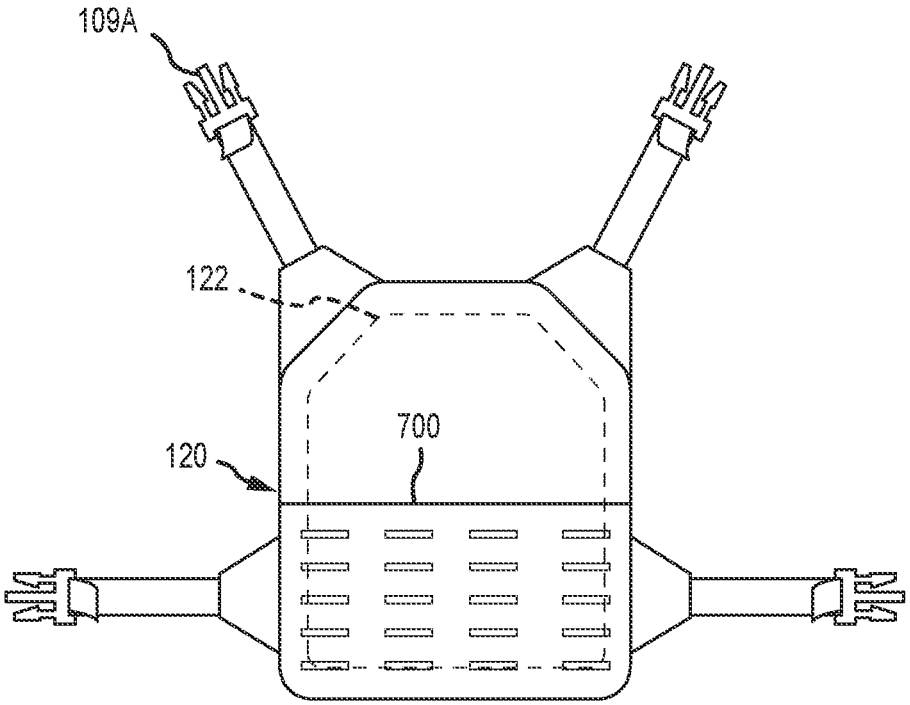
FIG. 7 is an exterior rear view of the pouch of FIG. 1 according to various embodiments.

FIG. 7 is an exterior perspective view of the pouch 120 according to some embodiments. The pouch 120 can include a gear attachment platform 700. The outer carrier 100 is not limited to such a gear attachment system, however, and additionally or alternatively may include any suitable systems for attachment of gear, which may include, but are not limited to, features compatible with PALS (Pouch Attachment Ladder System), MOLLE (Modular Lightweight Load-carrying Equipment), and/or other systems. The gear attachment platform 700 may be positioned at any position suitable for mounting gear. In various examples, the gear attachment platform 700 may be arranged to effectively provide a replacement for an attachment surface that may be covered on the rear panel 104 when the pouch 120 is in place and arranged overlaying the rear panel 104. The outer carrier 100 further may be configurable to switch between different gear attachment features.

The pouch 120 can be utilized with structure referenced in other figures herein. For example, the pouch 120 can be attached or attachable by at least one strap 114 to the outer carrier 100 such that the wearer can switch between a loading position and a protection position, e.g., as shown in FIGS. 1-3. In the loading position, the pouch 120 can be suspended by the strap 114 and hanging along and exterior to the front panel of the outer carrier 100. This can allow the wearer to load the insert 124 into the pouch 120 (e.g., as represented in FIG. 1). In the protection position, the pouch 120 can be suspended by the strap 114 and can be overlaying an exterior portion of the rear panel 104 of the outer carrier 100.

Figure 8:
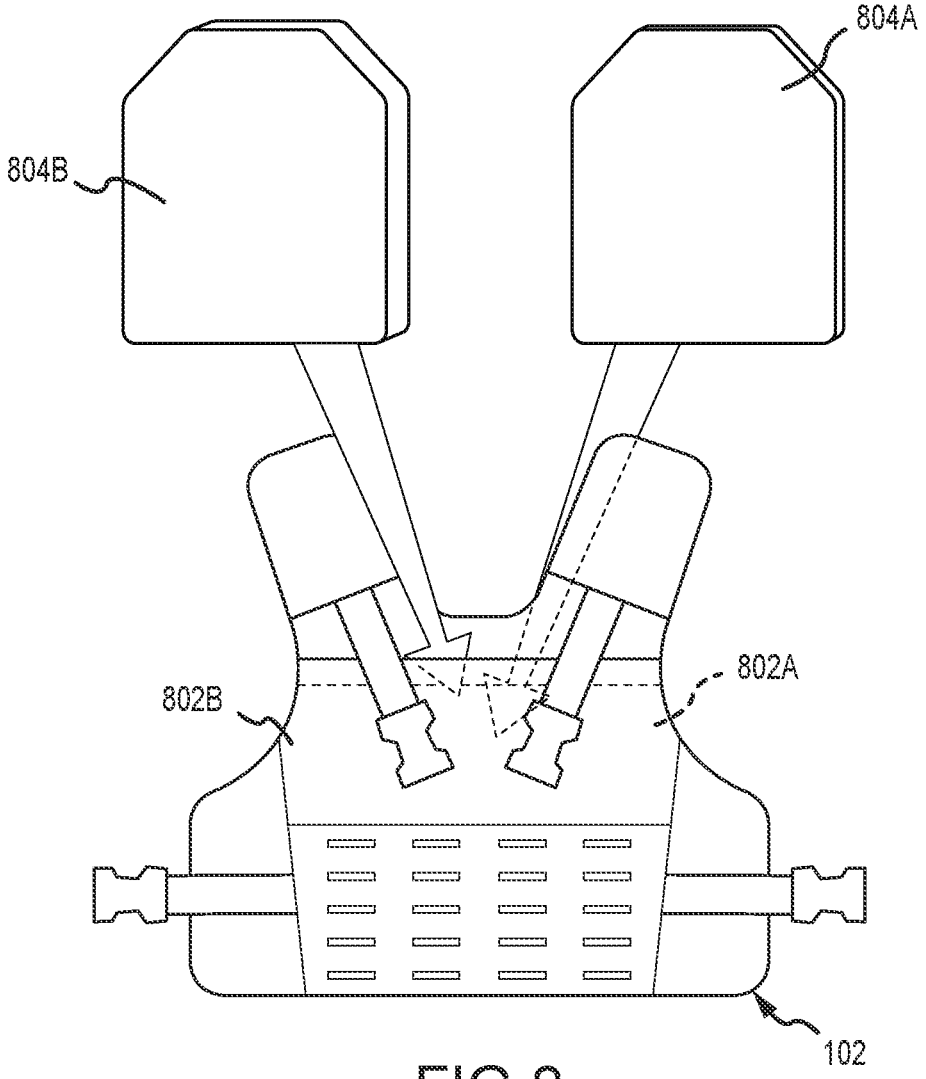
FIG. 8 is a front view of a front panel of the outer carrier of FIG. 1 according to various embodiments.

FIG. 8 is a front view of the front panel 102 of the outer carrier 100 according to various embodiments. The front panel 102 can include one or more front pockets 802A-B that can receive and store one or more front inserts 804A-B. For example, the front panel 102 can include an outer front pocket 802B and/or an inner front pocket 802A. The inner front pocket 802A may be accessible from a body-facing side of the front panel 102, while the outer front pocket 802B may be accessible from an outwardly-facing side of the front panel 102. The inner front pocket 802A can receive a first front insert 804A, and the outer front pocket 802B can receive a second front insert 804B in some examples. The second front insert 804B can include a heavy armor plate, and the first front insert 804A can include a lighter and/or more flexible armor plate, for example. In some examples, the wearer of the outer carrier 100 or another individual can load the first front insert 804A into the inner front pocket 802A. The wearer or other individual can load the second front insert 804B into the outer front pocket 802B. In various examples, the first front insert 804A may be loaded prior to donning the outer carrier 100 (e.g., as a lighter-weight baseline level of armor protection that may be suitable for many scenarios), and the second front insert 804B can be loaded after donning the outer carrier 100 (e.g., such as if the wearer before or after donning determines that additional armor may be warranted). For example, the wearer may be able to readily reach the accessible front outer pocket 802B to install the second front insert 804B to augment the armor level already provided by the lighter first front insert 804A.

Figure 9:
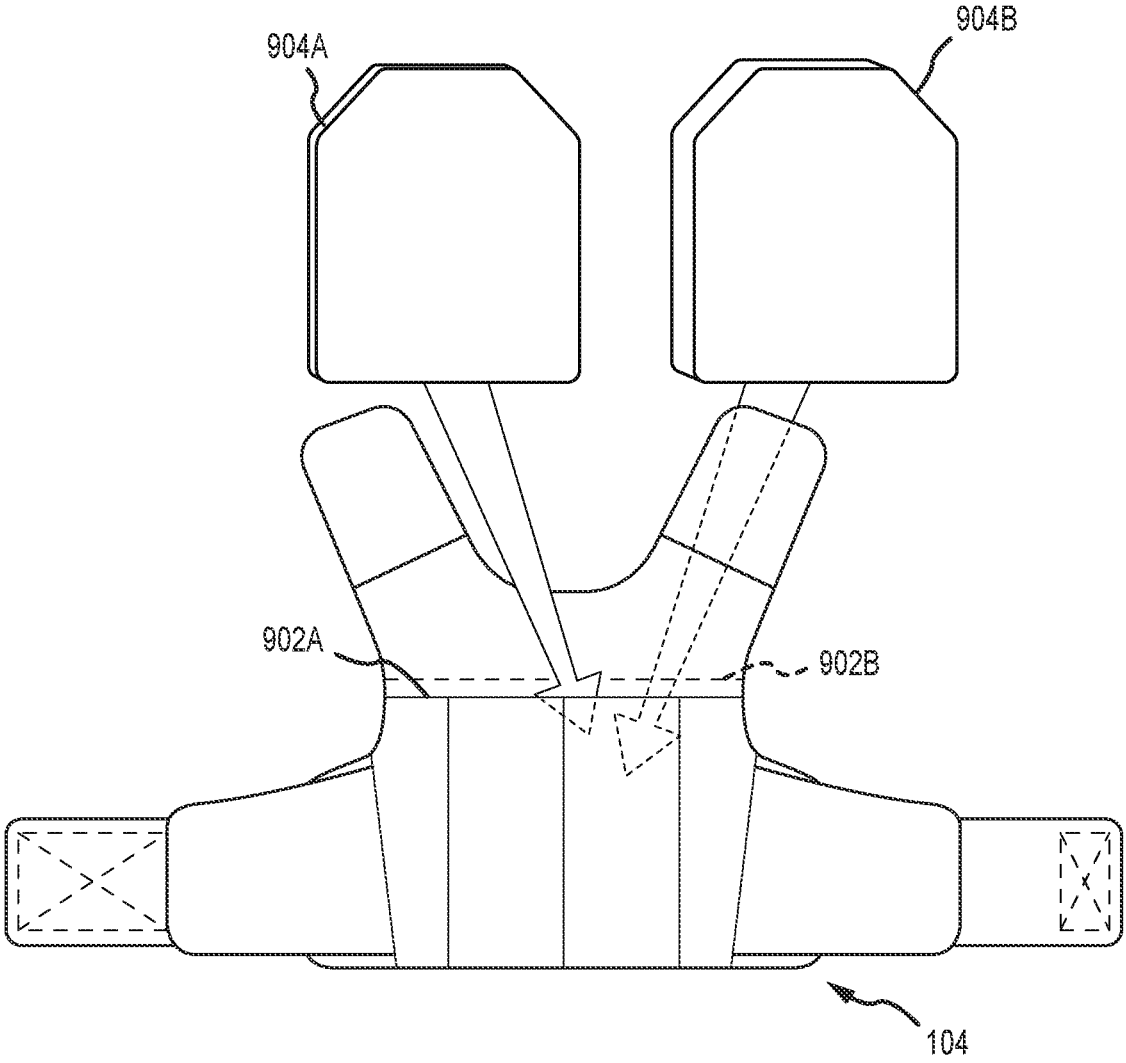
FIG. 9 is a rear-facing view of a rear panel of the outer carrier of FIG. 1 according to various embodiments.

FIG. 9 is a rear-facing view of the rear panel 104 of the outer carrier according to various embodiments. The rear panel 104 can include one or more rear pockets 902A-B that can receive and store one or more rear inserts 904A-B. For example, the rear panel 104 can include an inner rear pocket 902A and/or an outer rear pocket 902B. The inner rear pocket 902A may be accessible from a body-facing side of the rear panel 104, while the outer rear pocket 902B may be accessible from an outwardly-facing side of the rear panel 104, for example. The inner rear pocket 902A can receive a first rear insert 904A, and the outer rear pocket 902B can receive a second rear insert 904B in some examples. The second rear insert 904B can include a heavy armor plate, and the first rear insert 904A can include a lighter and/or more flexible armor plate, for example. In some examples, the wearer of the outer carrier 100 or another individual can load the first rear insert 904A into the inner rear pocket 902A. The wearer or other individual can load the second rear insert 904B into the outer rear pocket 902B. In various examples, the first rear insert 904A may be loaded prior to donning the outer carrier 100 (e.g., as a lighter-weight baseline level of armor protection that may be suitable for many scenarios), and the second rear insert 904B can be loaded after donning the outer carrier 100 (e.g., such as if the wearer before or after donning determines that additional armor may be warranted). For example, if available, another individual may assist the wearer by reaching the rear outer pocket 902B to install the second rear insert 904B to augment the armor level already provided by the lighter first rear insert 904A. Alternatively, the pouch 120 may be utilized to allow augmenting of an armor level independent of whether another individual is available to assist and/or independent of whether the second rear insert 904B is installed in the rear outer pocket 902B.

Figure 10:
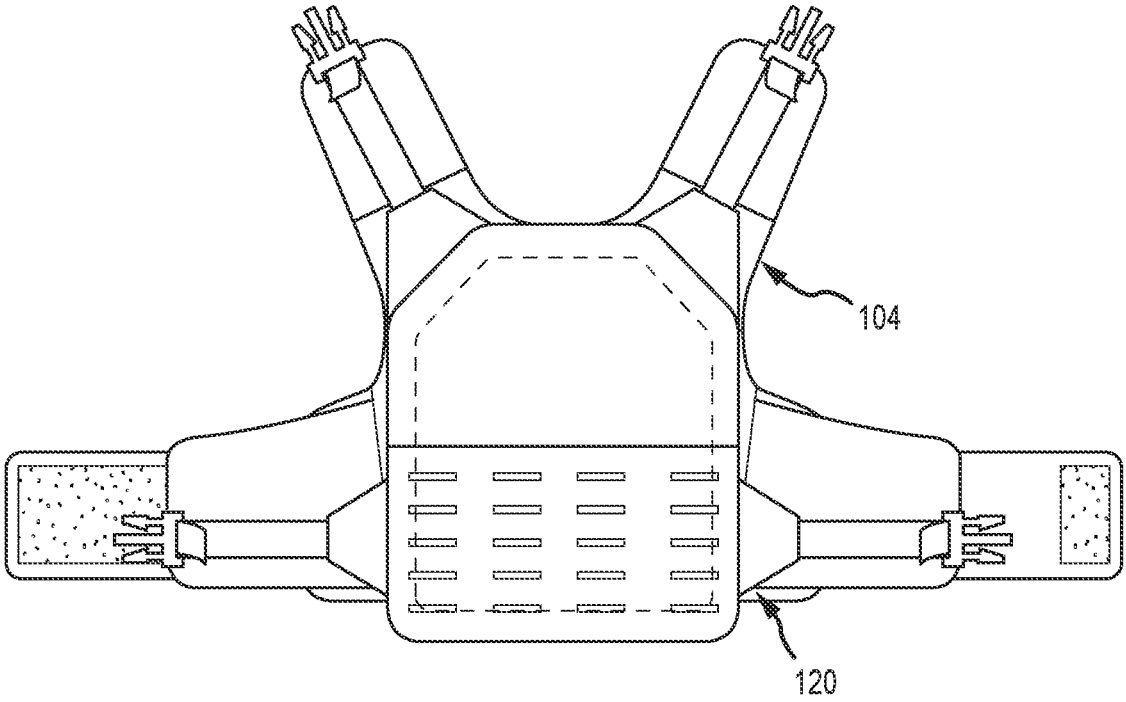
FIG. 10 is a rear view of the overhead-deployable pouch overlaying the rear panel of the outer carrier of FIG. 1 according to various embodiments.

FIG. 10 is a rear view of the overhead-deployable pouch 120 overlaying the rear panel 104 of the outer carrier 100 according to various embodiments. The pouch 120 may be moved into position to overlay the rear panel 104 to augment a level of armor, e.g., regardless of whether the first rear insert 904A or the second rear insert 904B discussed with respect to FIG. 9 are utilized. The pouch 120 may allow the wearer to individually perform operations for augmenting the posterior armor level. For example, all relevant operations may be performed by one person, which may be the wearer (e.g., rather than being assisted by another person).

In an illustrative example, the wearer of the outer carrier 100 may receive information while en route to a tactical situation. For example, the wearer of the outer carrier 100 may learn that armor-piercing ammunition is being used by one or more hostiles in the tactical situation and/or that other conditions are present that may benefit from an augmented armor level. In a baseline configuration of the outer carrier 100, heavy armor plates may be not yet equipped (e.g., the outer pockets 902B and 802B may be empty). The inner pockets 902A and 802A can include light armor inserts 904A and 804A, respectively, for example. It may be desirable to augment the armor level of the outer carrier 100 without requiring assistance from another individual. The wearer can load the outer front pocket 802B with a heavy armor insert 804B to augment the anterior armor level of the outer carrier 100. However, loading the outer rear pocket 902B can be difficult, since it is positioned behind the wearer while the outer carrier 100 is donned and may not be easy for the wearer to reach. It may be desirable to augment the posterior armor level of the outer carrier 100 without requiring another individual to load a heavy armor insert 904B into the outer rear pocket 902B and/or without requiring the wearer to doff the outer carrier 100 to load the heavy armor insert 904B into the outer rear pocket 902B.

Continuing this illustrative example, to augment the posterior armor level of the outer carrier 100, the wearer can utilize the pouch 120. In some examples, the pouch 120 can include a set of releasable connectors 108, e.g., such that the wearer may remove the pouch 120 from a duffel bag or other location and releasably couple the pouch 120 to the outer carrier 100. In a loading or ready state, the pouch 120 can hang in front of the wearer. The pouch 120 may have the insert 124 pre-installed, or the wearer may install the insert 124 into the pouch 120 while the pouch 120 is hanging from and/or otherwise in front of the wearer (e.g., best shown in FIG. 1). The wearer can move the pouch 120 from a front position to a rear position (e.g., as illustrated by the arrow 200 in FIG. 2). In the rear position, the pouch 120 may overlay and/or overlap the rear panel 104 (e.g., as illustrated in FIG. 10). In the rear position, the pouch 120 may augment the level of posterior armor. In the rear position, the pouch 120 may be secured by releasable connectors 108 along a side of the wearer (e.g., FIG. 3), which may reduce a chance of the pouch 120 bouncing or otherwise moving out of position in use.

In an alternative sequence, the pouch 120 may start in an installed position at the rear of the outer carrier 100 (e.g., FIG. 3) but may start out empty. The wearer may manipulate the releasable connectors 108 along sideward straps 115 to free the pouch 120 for movement, for example. The pouch 120 may be swung forward overhead (e.g., contrary to the direction shown by arrow 200 in FIG. 2). Once at the front of the wearer, the pouch 120 can be detached and swapped for a loaded pouch 120, and/or the wearer may load the insert 124 into the pouch 120 while the pouch 120 is accessible along the front of the wearer. Once the pouch 120 is loaded and/or attached, it may be swung overhead (e.g., as at arrow 200 in FIG. 2) to reach a rear position of augmenting a rear armor level (e.g., where the releasable connectors 108 if present may be used for securing the pouch 120 in place, such as to reach the state shown in FIG. 3).

Other variations are also possible. For example, although the above description relating to FIGS. 8 and 9 describe examples in which each of the front panel 102 and the rear panel 104 each include inner and outer pockets 802A, 802B, 902A, 902B, the outer carrier 100 may be provided with fewer pockets and still be within the scope of the present disclosure. Similarly, other elements may be omitted or included without departing from the scope of the present disclosure.

Other variations are within the spirit of the present invention. Thus, while the invention is susceptible to various modifications and alternative constructions, certain illustrated embodiments thereof are shown in the drawings and have been described above in detail. It should be understood, however, that there is no intention to limit the invention to the specific form or forms disclosed, but on the contrary, the intention is to cover all modifications, alternative constructions, and equivalents falling within the spirit and scope of the invention, as defined in the appended claims.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate embodiments of the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

All references, including publications, patent applications, and patents, cited herein are hereby incorporated by reference to the same extent as if each reference were individually and specifically indicated to be incorporated by reference and were set forth in its entirety herein.

What is claimed is:

1. A method of augmenting a level of posterior armor protection for a wearer without requiring assistance from another individual and without requiring doffing to load armor, the method comprising:

positioning a carrier in a worn position on a torso of the wearer, wherein the carrier in the worn position comprises (i) a front panel comprising a front pocket holding a front portion of armor along an anterior of the torso, and (ii) a rear panel comprising a rear pocket holding a rear portion of armor along a posterior of the torso;

positioning an armor pouch in a front position in which the armor pouch is suspended by at least one strap from the carrier worn by the wearer and in which the armor pouch is hanging along a front side of the carrier; and pivoting the armor pouch overhead to a rear position in which the armor pouch is suspended by the at least one strap and is overlaying an exterior portion of the rear panel along a rear side of the carrier worn by the wearer.

2. The method of claim 1, further comprising:

loading armor into the armor pouch in the front position.

3. The method of claim 1, further comprising:

releasably attaching the armor pouch to the at least one strap by a releasable connector, wherein the positioning the armor pouch in the front position occurs subsequent to the releasably attaching.

4. The method of claim 1, further comprising:

releasably securing the armor pouch in the rear position by engagement of a releasable connector extending along a lateral side of the carrier.

5. The method of claim 1, wherein the method is performed by one person, wherein the one person is the wearer.

6. A carrier for performing the method of claim 1.

7. An armor system, comprising:

a carrier configured to be donned into a worn position on a torso of a wearer, the carrier comprising:

a front panel comprising a front pocket configured for holding a front portion of armor along an anterior of the torso in the worn position; and a rear panel comprising a rear pocket configured for holding a rear portion of armor along a posterior of the torso in the worn position; and an armor pouch attached or attachable by at least one strap to the carrier so as to be reconfigurable by overhead movement between (i) a loading configuration in which the armor pouch is suspended by the at least one strap and hanging along and exterior to the front panel, and (ii) a protection configuration in which the armor pouch is suspended by the at least one strap and is overlaying an exterior portion of the rear panel.

8. The armor system of claim 7, wherein the at least one strap comprises a first strap and a second strap sized and spaced apart for passing by respectively on a left side and a right side of a head of the wearer during reconfiguration between the loading configuration and the protection configuration.

9. The armor system of claim 7, further comprising a releasable connector included in or coupled with the at least one strap and by which the armor pouch is releasably attachable and releasably detachable from the carrier.

10. The armor system of claim 7, further comprising a releasable connector positioned or positionable along a lateral side of the carrier and engageable to secure the armor pouch in the protection configuration.

11. An armor system, comprising:

a carrier configured to be donned into a worn position on a torso of a wearer, the carrier comprising:

a rear panel comprising a rear pocket configured for holding a rear portion of armor along a posterior of the torso in the worn position;

a front panel comprising a front pocket configured for holding a front portion of armor along an anterior of the torso in the worn position;

a set of straps and releasable connectors comprising:

an upper left strap attached at an upper left portion of the carrier and bearing an upper left releasable connector;

an upper right strap attached at an upper right portion of the carrier and bearing an upper right releasable connector;

a lower left strap attached at a lower left portion of the carrier and bearing a lower left releasable connector; and a lower right strap attached at a lower right portion of the carrier and bearing a lower right releasable connector, wherein the set of straps and releasable connectors are arranged to facilitate attachment by the upper left releasable connector and the upper right releasable connector to an upper portion of an armor pouch so as to render the armor pouch pivotable by the upper left strap and the upper right strap for overhead movement of the armor pouch to a rear position in which the armor pouch is overlaying an exterior portion of the rear panel and attachable at a lower portion of the armor pouch with the lower left releasable connector and the lower right releasable connector.

12. The armor system of claim 11, further comprising the armor pouch.

13. The armor system of claim 12, further comprising armor positioned within the armor pouch.

14. The armor system of claim 11, wherein the lower left strap and the lower right strap are attached to the front panel.

15. The armor system of claim 14, further comprising at least one sleeve included on the front panel and arranged for stowing of one or both of the lower left releasable connector or the lower right releasable connector when not engaged with the armor pouch.

16. The armor system of claim 11, further comprising a left shoulder strap and a right shoulder strap configured to extend between the front panel and the rear panel, wherein the upper left strap is attached to the left shoulder strap, and wherein the upper right strap is attached to the right shoulder strap.

17. The armor system of claim 16, further comprising:

an upper left sleeve on the left shoulder strap for stowing the upper left releasable connector when not engaged with the armor pouch; and an upper right sleeve on the right shoulder strap for stowing the upper right releasable connector when not engaged with the armor pouch.

* * * * *